US008284901B2

(12) United States Patent
Rogers et al.

(10) Patent No.: US 8,284,901 B2
(45) Date of Patent: Oct. 9, 2012

(54) APPARATUS AND METHOD FOR IMPROVED TRANSIENT RESPONSE IN AN ELECTROMAGNETICALLY CONTROLLED X-RAY TUBE

(75) Inventors: Carey Shawn Rogers, Brookfield, WI (US); Mark Alan Frontera, Ballston Lake, NY (US); Ethan James Westcot, Wauwatosa, WI (US); Peter Andras Zavodszky, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 212 days.

(21) Appl. No.: 12/911,923

(22) Filed: Oct. 26, 2010

(65) Prior Publication Data

US 2012/0099708 A1 Apr. 26, 2012

(51) Int. Cl.
*H01J 35/30* (2006.01)

(52) U.S. Cl. ..... 378/137; 378/121

(58) Field of Classification Search ..... 378/4–20, 378/62, 119–144

See application file for complete search history.

(56) References Cited

U.S. PATENT DOCUMENTS

| | | | | |
|---|---|---|---|---|
| 6,128,367 | A | 10/2000 | Foerst et al. | 378/137 |
| 6,292,538 | B1 | 9/2001 | Hell et al. | 378/137 |
| 2002/0186816 | A1 | 12/2002 | Freudenberger et al. | 378/144 |
| 2010/0020937 | A1 | 1/2010 | Hautmann et al. | 378/137 |

FOREIGN PATENT DOCUMENTS

WO 2008155695 A1 12/2008

OTHER PUBLICATIONS

Schwartz, "Brazing: for the engineering technologist," Springer, 1995, p. 297.

*Primary Examiner* — Courtney Thomas
(74) *Attorney, Agent, or Firm* — Ziolkowski Patent Solutions Group, SC

(57) ABSTRACT

An x-ray tube assembly includes a vacuum enclosure that includes a cathode portion, a target portion, and a throat portion having a plurality of recesses formed therein to break up eddy currents generated in the throat portion. The throat portion has an upstream end coupled to the cathode portion and a downstream end coupled to the target portion. The x-ray tube assembly also includes a target positioned within the target portion of the vacuum enclosure, and a cathode positioned within the cathode portion of the vacuum enclosure. The cathode is configured to emit a stream of electrons through the throat portion toward the target.

20 Claims, 6 Drawing Sheets

APPARATUS AND METHOD FOR IMPROVED TRANSIENT RESPONSE IN AN ELECTROMAGNETICALLY CONTROLLED X-RAY TUBE

BACKGROUND OF THE INVENTION

Embodiments of the invention relate generally to diagnostic imaging and, more particularly, to an apparatus and method for improved transient response in an electromagnetically controlled x-ray tube.

X-ray systems typically include an x-ray tube, a detector, and a support structure for the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then transmits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in an x-ray scanner or computed tomography (CT) package scanner.

X-ray tubes include a rotating target structure for the purpose of distributing the heat generated at a focal spot. The target is typically rotated by an induction motor having a cylindrical rotor built into a cantilevered axle that supports a disc-shaped target and an iron stator structure with copper windings that surrounds an elongated neck of the x-ray tube. The rotor of the rotating target assembly is driven by the stator.

One skilled in the art will recognize that the operation described herein need not be limited to a single X-ray tube configuration, but is applicable to any X-ray tube configuration. For instance, in one embodiment the target and frame of the X-ray tube may be held at ground potential and the cathode may be maintained at the desired potential difference, while in another embodiment the X-ray tube may operate in a bipolar arrangement having a negative voltage applied to a cathode and a positive voltage applied to an anode.

An x-ray tube cathode provides an electron beam that is accelerated using a high voltage applied across a cathode-to-target vacuum gap to produce x-rays upon impact with the target. The area where the electron beam impacts the target is often referred to as the focal spot. Typically, the cathode includes one or more cylindrical-coil or flat filaments positioned within a cup for providing electron beams to create a high-power, large focal spot or a high-resolution, small focal spot, as examples. Imaging applications may be designed that include selecting either a small or a large focal spot having a particular shape, depending on the application. Typically, an electrically resistive emitter or filament is positioned within a cathode cup, and an electrical current is passed therethrough, thus causing the emitter to increase in temperature and emit electrons when in a vacuum.

The shape of the emitter or filament and the shape of the cathode cup that the filament is positioned within affects the focal spot. In order to achieve a desired focal spot shape, the cathode may be designed taking the shape of the filament and cathode cup into consideration. However, the shape of the filament is not typically optimized for image quality or for thermal focal spot loading. Conventional filaments are primarily shaped as coiled or helical tungsten wires for reasons of manufacturing and reliability. Alternative design options may include alternate design profiles, such as a coiled D-shaped filament. Therefore, the range of design options for forming the electron beam from the emitter may be limited by the filament shape, when considering electrically resistive materials as the emitter source.

Electron beam (e-beam) wobbling is often used to enhance image quality. Wobble may be achieved using electrostatic e-beam deflection or magnetic deflection (i.e., spatial modulation), which utilizes a rapidly changing magnetic field to control the e-beam. Likewise, a rapidly changing magnetic field may be used to rapidly change the focusing of the electron beam (i.e., change the cross-sectional size of the electron beam in width and length directions). Typically, a pair of quadruple magnets are used to achieve electron beam focusing in both width and length directions. For certain scan modes, such as rapid kV modulation, or so-called dual-energy scanning, the ability to rapidly adjust the focusing magnetic field is advantageous to maintain the focal spot size constant between the kV levels. Such electromagnetic e-beam control may achieve a high image quality by ensuring that the electron beam moves from one position to the next or refocuses as quickly as possible while staying in the desired position or at the desired focus without straying. However, when current in the electromagnets is rapidly changed to generate the changing magnetic field, eddy currents are generated in the vacuum vessel wall that opposes the magnetic field penetration inside the x-ray tube. The eddy currents increase the rise time of the magnetic field inside the throat of the x-ray tube, which slows the deflection or refocusing time of the e-beam. Accordingly, it would be desirable to design an x-ray tube having a throat portion that minimizes eddy current losses to optimize the transient magnetic field developed at the electron beam.

The configuration of the x-ray tube throat is subject to a number of design constraints. During operation, the throat experiences significant heat fluxes in the x-ray tube environment due to backscattered electrons from the target, for example. Further, the throat should be easy to manufacture and easy to join with interface components while still being capable of maintaining a hermetic vacuum and withstanding atmospheric pressure.

Therefore, it would be desirable to design an apparatus and method for improving the transient response in an electromagnetically controlled x-ray tube that satisfies the above-described design constraints and overcomes the aforementioned drawbacks.

BRIEF DESCRIPTION OF THE INVENTION

In accordance with one aspect of the invention, an x-ray tube assembly includes a vacuum enclosure that includes a cathode portion, a target portion, and a throat portion having a plurality of recesses formed therein to break up eddy currents generated in the throat portion. The throat portion has an upstream end coupled to the cathode portion and a downstream end coupled to the target portion. The x-ray tube assembly also includes a target positioned within the target portion of the vacuum enclosure, and a cathode positioned within the cathode portion of the vacuum enclosure. The cathode is configured to emit a stream of electrons through the throat portion toward the target.

In accordance with another aspect of the invention, an x-ray tube assembly includes a housing having a vacuum formed therein. The housing has a cathode portion, a target portion, and a throat portion coupling the cathode portion to the target portion. The throat portion includes a metal wall having a pattern of slits formed therein. The x-ray tube assembly also includes a target positioned in the target portion of the housing, and a cathode positioned in the cathode portion of the housing to direct a stream of electrons toward the target through the throat portion.

In accordance with another aspect of the invention, an imaging system includes a rotatable gantry having an opening therein for receiving an object to be scanned, a table positioned within the opening of the rotatable gantry and moveable through the opening, and an x-ray tube coupled to the rotatable gantry. The x-ray tube includes a vacuum chamber that has a target portion housing a target, a cathode portion housing a cathode, and a throat portion comprising a first magnetic field section susceptible to eddy current generation. The first magnetic field section of the throat portion has a first plurality of recesses formed therein. The throat portion forms a passageway between the cathode portion and the target portion for a stream of electrons emitted from the cathode. The imaging system also includes a first electron manipulation coil configured to generate a first magnetic field within the throat portion to manipulate the stream of electrons therein. The first electron manipulation coil is mounted on the x-ray tube and aligned with the first magnetic field section of the throat portion such that the first plurality of recesses break up eddy currents generated by the first magnetic field.

Various other features and advantages will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

The operating environment of embodiments of the invention is described with respect to a computed tomography (CT) system. It will be appreciated by those skilled in the art that embodiments of the invention are equally applicable for use with any multi-slice configuration. Moreover, embodiments of the invention will be described with respect to the detection and conversion of x-rays. However, one skilled in the art will further appreciate that embodiments of the invention are equally applicable for the detection and conversion of other high frequency electromagnetic energy. Embodiments of the invention will be described with respect to a "third generation" CT scanner, but is equally applicable with other CT systems, surgical C-arm systems, and other x-ray tomography systems as well as numerous other medical imaging systems implementing an x-ray tube, such as x-ray or mammography systems.

Figure 1:
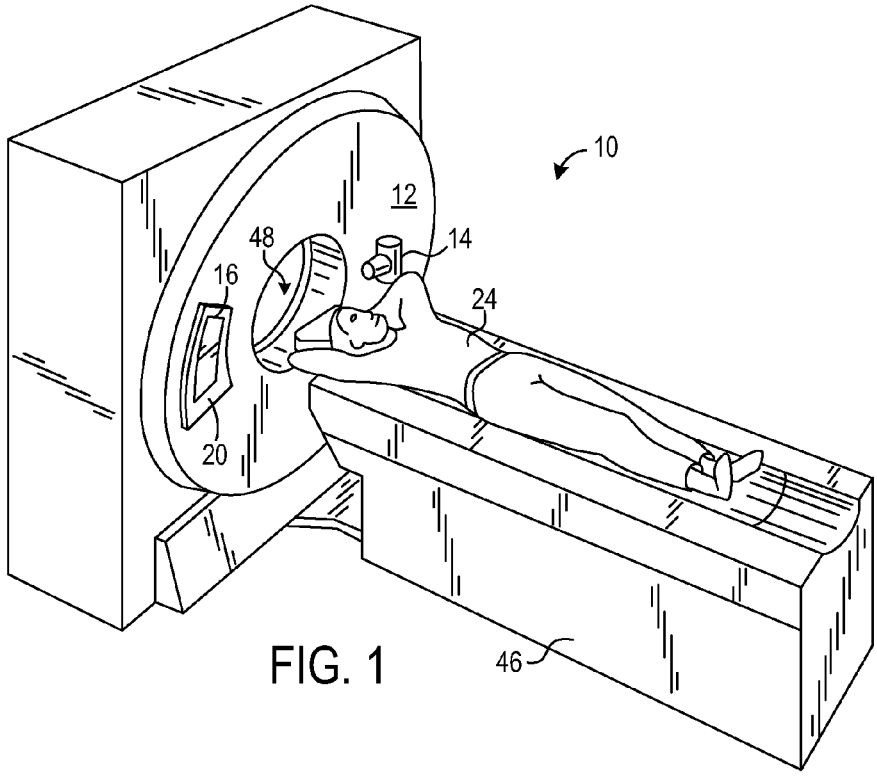
FIG. 1 is a pictorial view of an imaging system.

FIG. 1 is a block diagram of an embodiment of an imaging system 10 designed both to acquire original image data and to process the image data for display and/or analysis in accordance with the present invention. It will be appreciated by those skilled in the art that the present invention is applicable to numerous medical imaging systems implementing an x-ray tube, such as x-ray or mammography systems. Other imaging systems such as computed tomography systems and digital radiography systems, which acquire image three dimensional data for a volume, also benefit from the present invention. The following discussion of x-ray system 10 is merely an example of one such implementation and is not intended to be limiting in terms of modality.

Figure 2:
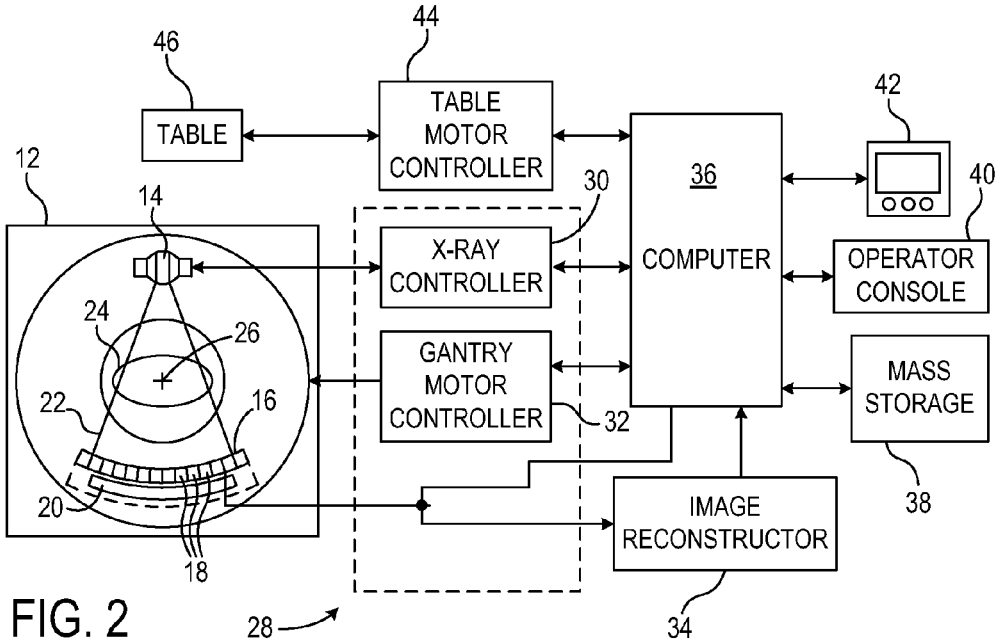
FIG. 2 is a block schematic diagram of the system illustrated in FIG. 1.

Referring to FIG. 1, a computed tomography (CT) imaging system 10 is shown as including a gantry 12 representative of a "third generation" CT scanner. Gantry 12 has an x-ray tube assembly or x-ray source assembly 14 that projects a cone beam of x-rays toward a detector assembly or collimator 16 on the opposite side of the gantry 12. Referring now to FIG. 2, detector assembly 16 is formed by a plurality of detectors 18 and data acquisition systems (DAS) 20. The plurality of detectors 18 sense the projected x-rays 22 that pass through a medical patient 24, and DAS 20 converts the data to digital signals for subsequent processing. Each detector 18 produces an analog electrical signal that represents the intensity of an impinging x-ray beam and hence the attenuated beam as it passes through the patient 24. During a scan to acquire x-ray projection data, gantry 12 and the components mounted thereon rotate about a center of rotation 26.

Rotation of gantry 12 and the operation of x-ray source assembly 14 are governed by a control mechanism 28 of CT system 10. Control mechanism 28 includes an x-ray controller 30 that provides power and timing signals to an x-ray source assembly 14 and a gantry motor controller 32 that controls the rotational speed and position of gantry 12. An image reconstructor 34 receives sampled and digitized x-ray data from DAS 20 and performs high speed reconstruction. The reconstructed image is applied as an input to a computer 36 which stores the image in a mass storage device 38. Computer 36 also has software stored thereon corresponding to electron beam positioning and magnetic field control, as described in detail below.

Computer 36 also receives commands and scanning parameters from an operator via console 40 that has some form of operator interface, such as a keyboard, mouse, voice activated controller, or any other suitable input apparatus. An associated display 42 allows the operator to observe the reconstructed image and other data from computer 36. The operator supplied commands and parameters are used by computer 36 to provide control signals and information to DAS 20, x-ray controller 30 and gantry motor controller 32. In addition, computer 36 operates a table motor controller 44 which controls a motorized table 46 to position patient 24 and gantry 12. Particularly, table 46 moves patient 24 through a gantry opening 48 of FIG. 1 in whole or in part.

Figure 3:
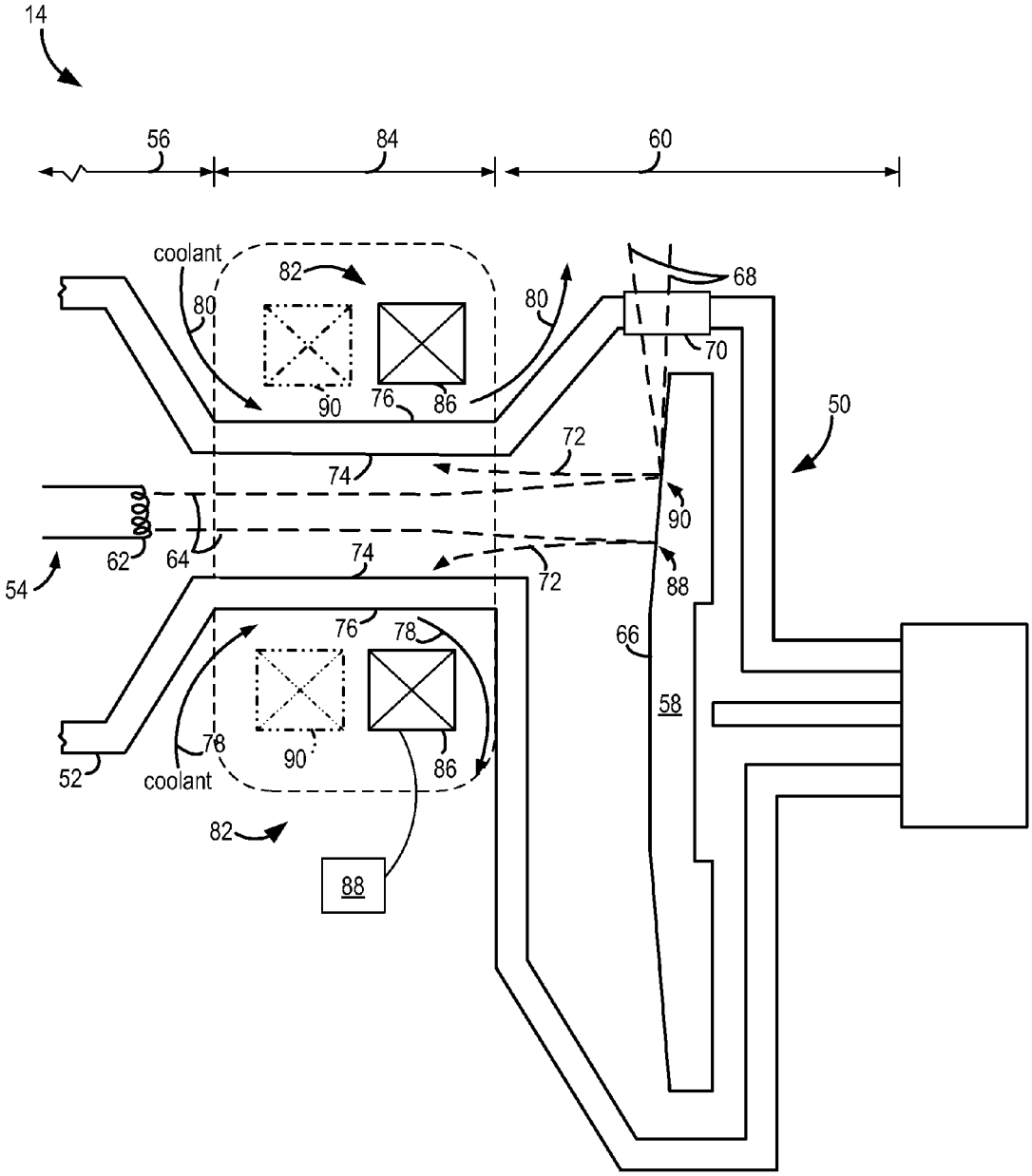
FIG. 3 is a cross-sectional view of an x-ray tube assembly according to an embodiment of the invention and useable with the imaging system illustrated in FIG. 1.

FIG. 3 illustrates a cross-sectional view of x-ray tube assembly 14 according to an embodiment of the invention. X-ray tube assembly 14 includes an x-ray tube 50 that includes a vacuum chamber or enclosure 52 having a cathode assembly 54 positioned in a cathode portion 56 thereof. A rotating target 58 is positioned in a target portion 60 of vacuum enclosure or housing 52. Cathode assembly 54 includes a number of separate elements, including a cathode cup (not shown) that supports a filament 62 and serves as an electrostatic lens that focuses a beam of electrons 64 emitted from heated filament 62 toward a surface 66 of target 58. A stream of x-rays 68 is emitted from surface 66 of target 58 and is directed through a window 70 of vacuum enclosure 52. A number of electrons 72 are backscattered from target 58 and impact and heat an inner surface 74 of vacuum enclosure 52. A coolant is circulated along an outer surface 76 of vacuum enclosure 52, as illustrated by arrows 78, 80 to mitigate heat generated in vacuum enclosure 52 by backscattered electrons 72.

A magnetic assembly 82 is mounted in x-ray tube assembly 14 at a location near the path of electron beam 64 within a throat portion 84 of vacuum enclosure 52, which is downstream from cathode portion 56 and upstream from target portion 60. Magnetic assembly 82 includes a first coil assembly 86. According to one embodiment, coil 86 is wound as a quadruple and/or dipole magnetic assembly and is positioned over and around throat portion 84 of vacuum chamber 52 such that a magnetic field generated by coil 86 acts on electron beam 64, causing electron beam 64 to deflect and move along either the x- and/or y-directions. The direction of movement of electron beam 64 is determined by the direction of current flow though coil 86, which is controlled via a control circuit 88 coupled to coil 86. According to another embodiment, coil 86 is configured to control a focal spot size or geometry. Optionally, a second coil assembly 90 (shown in phantom) may also be included in magnetic assembly 82, as shown in FIG. 3. Coil assemblies 86, 90 may have dipole and/or quadruple configurations, according to various embodiments and based on a desired electron beam control.

Embodiments of the invention set forth herein reduce the generation of eddy currents within the section of the x-ray tube throat 84 that is aligned with coil assemblies 86, 90, which allows the desired magnetic field to develop more rapidly. Eddy currents are developed in throat section 84 whenever the magnetic field is changing in magnitude, spatially or temporally. Eddy currents are not present when the magnetic field is unchanging. Consequently, the embodiments set forth herein are directed toward reducing the eddy current generation that would take place in a baseline metal throat section that is of a uniform cross-sectional thickness and volume, while simultaneously maintaining desired design specifications of throat section 84. Such design specifications may be, for example, that throat section 84 is hermetic, structurally robust to resist atmospheric pressure and other applied forces, thermally robust to heating primarily due to backscattered electrons, electrically conducting on an inside surface to provide a conduction path for collected charge, and joinable to cathode section 56 and target section 60 of vacuum enclosure 52.

Figure 4:
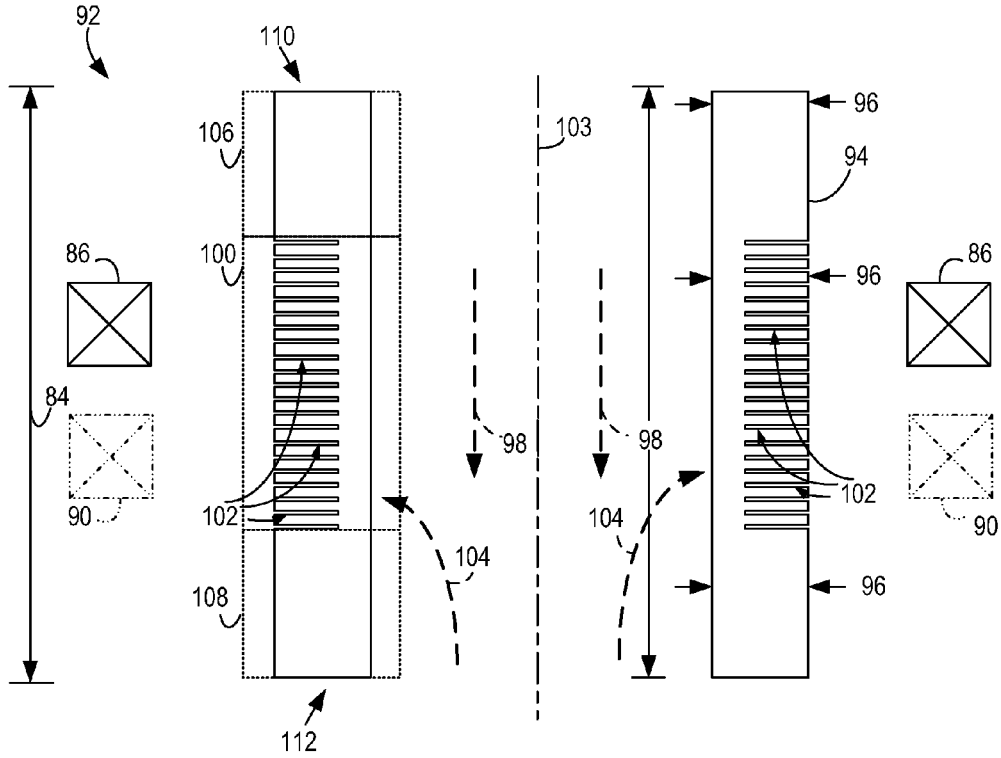
FIG. 4 is an enlarged portion of the throat of the x-ray tube assembly of FIG. 3, according to an embodiment of the invention.

FIG. 4 is an enlarged view of a subportion 92 of FIG. 3, according to one embodiment of the invention. Wall 94 of throat portion 84 is formed of metal and has an approximately constant thickness 96 along its length 98. Coil assembly 86 is aligned with a magnetic field section 100 of wall 94, which has a pattern of recesses or slits 102 formed therein. In one embodiment, slits 102 are formed perpendicular to a central axis 103 of throat 84. Slits 102 decrease current paths wherein eddy currents are produced and to break up eddy currents. Thus, slits 102 reduce eddy current generation while allowing magnetic field section 100 of wall 94 to maintain its structural integrity. Accordingly, wall 94 reduces eddy current generation by breaking up the eddy current paths while preserving a structurally sound throat section 84. Further, the thermal mass of throat section 84 absorbs the heat from backscattered electrons 104. While slits 102 are shown as being of equal length, slit length may be varied to control stiffness of wall 94. Further, slits 102 may be formed through the interior or exterior surfaces of wall 94, according to various embodiments.

First and second portions 106, 108 of wall 94, which are adjacent to magnetic field section 100, are formed of solid metal. An upstream end 110 of first portion 106 of wall 94 joins magnetic field section 100 to cathode portion 56 of vacuum chamber 52 (FIG. 3). Likewise, a downstream end 112 of second portion 108 of wall 94 joins magnetic field section 100 to target portion 60 of vacuum chamber 52 (FIG. 3).

Optionally, a second coil assembly 90 (shown in phantom) may be positioned adjacent to coil assembly 86 and aligned with magnetic field section 100, as shown in FIG. 4 for focusing the electron beam in length and width directions and deflecting the electron beam along two axes.

Figure 5:
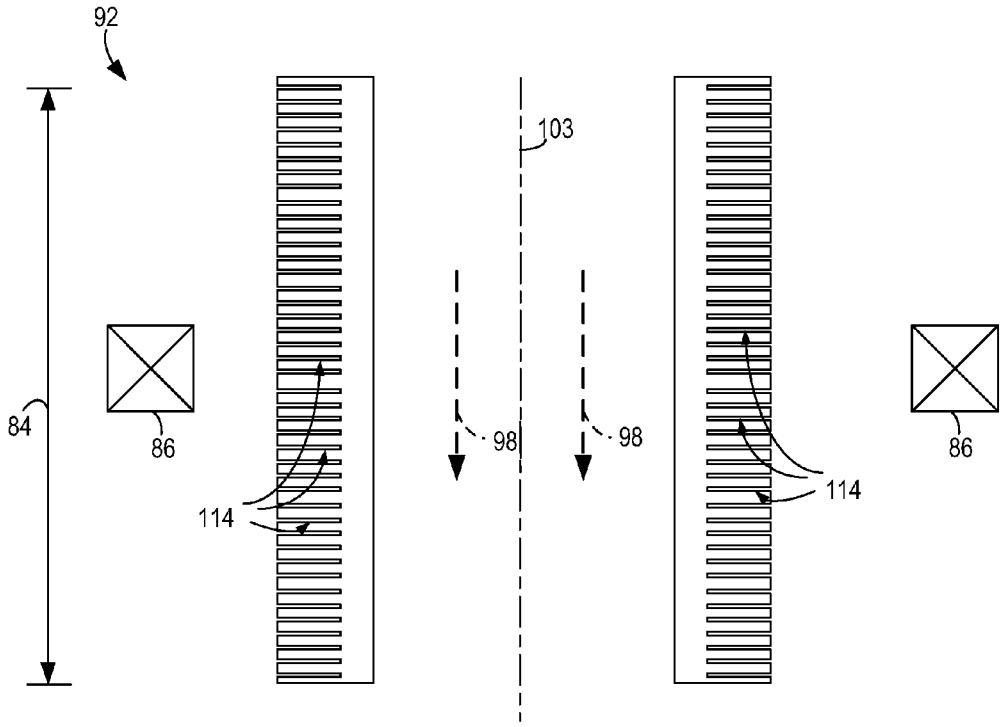
FIG. 5 is an enlarged portion of the throat of the x-ray tube assembly of FIG. 3, according to another embodiment of the invention.

Referring now to FIG. 5, an enlarged view of subportion 92 of FIG. 3 is shown according to an alternative embodiment wherein throat portion 84 is constructed having a number of slits 114 extending along approximately the entire length of throat portion 84. Coil assembly 86 is aligned with throat portion 84. Although FIG. 5 is described as including one coil assembly, one skilled in the art will recognize that embodiments thereof may be modified for an x-ray tube assembly having a pair of, or more, coil assemblies in a similar manner as described with respect to FIG. 4.

Figure 6:
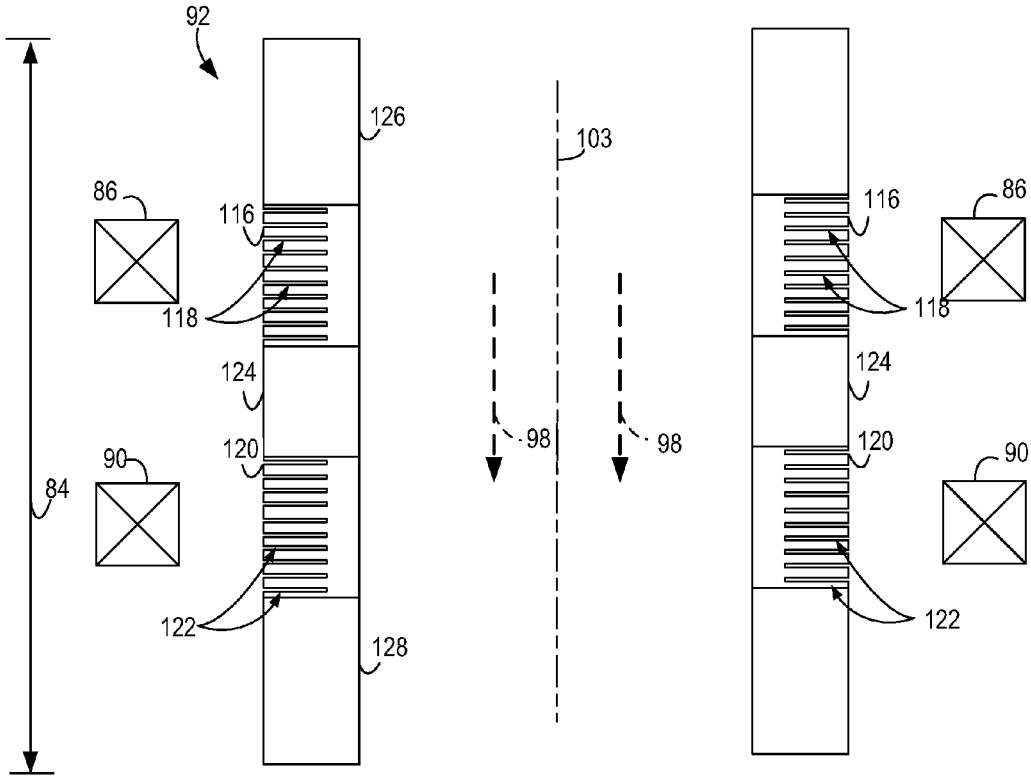
FIG. 6 is an enlarged portion of the throat of the x-ray tube assembly of FIG. 3, according to yet another embodiment of the invention.

FIG. 6 is an enlarged view of subportion 92 of FIG. 3, according to yet another embodiment. As shown, throat portion 84 includes a first magnetic field section 116 having a number of slits 118 formed in a pattern therein and a second magnetic field section 120 having a number of slits 122 formed in a pattern therein. As shown, coil assembly 86 is aligned with first magnetic field section 116 and second coil assembly 90 is aligned with second magnetic field section 120. A solid wall section 124 of throat portion 84 joins first magnetic field section 116 and second magnetic field section 120. Likewise, a solid upstream section 126 joins first magnetic field section 116 to cathode portion 56 of vacuum chamber 52 (FIG. 3) and a solid downstream section 128 joins second magnetic field section 120 to target portion 60 of vacuum chamber 52 (FIG. 3).

Figure 7:
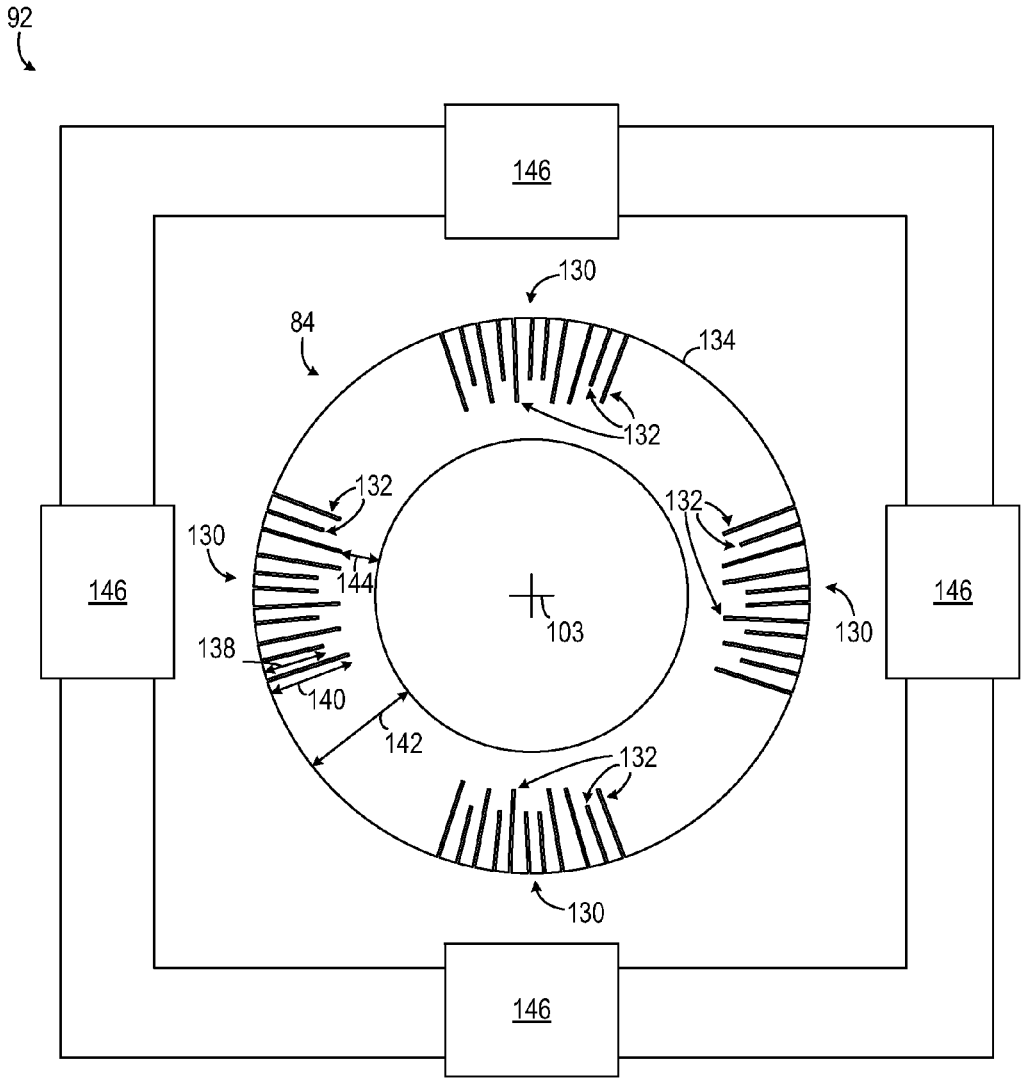
FIG. 7 is a cross-sectional view of the throat of the x-ray tube assembly of FIG. 3, according to another embodiment of the invention.

Referring now to FIG. 7, a cross-sectional view of subportion 92 of FIG. 3 is shown according to another embodiment. As shown, throat 84 has a number of slitted portions 130 containing a pattern of slits 132 formed through an outer surface 134 of throat 84. Slits 132 are oriented along a central axis 136 of the throat 84. By orienting slits 132 along central axis 136, slits 132 form additional cooling fins that increase the heat transfer rate of coolant flowing across outer surface 134 of throat 84. Slits 132 may be formed of varying lengths 138, 140, as shown, or of equal length based on design specifications. As illustrated in FIG. 7, slitted portions 130 of throat 84 have a solid material thickness 142 that is significantly thinner than the full wall thickness 144 of throat 84. Thus, the length of slits 132 may be selected to minimize solid material thickness 142 while maintaining the structural integrity of throat 84. The combination of the slits 132 and thinner wall thickness 142 reduces eddy current formation in slitted portions 130 compared to eddy current formation in a throat wall having full wall thickness 144 and is thermo-structurally robust to atmospheric pressure and the thermal environment of an x-ray tube. Thus, slitted portions 130 of throat 84 behave like a thick wall for thermostructural requirements, while behaving like a thin wall for eddy current generation.

FIG. 7 illustrates an embodiment wherein slits 132 are formed in a number of individual sections at locations on throat portion 84 proximate to individual poles 146 of a coil assembly, such as, for example coil assembly 86. However, slits 132 may also be patterned around the entire outer surface 134 of throat portion 84. In one embodiment, slits 132 extend along approximately the entire length of throat portion 84. Alternatively, slits 132 are shorter than the length of throat portion 84 and are aligned with individual poles 146 of a coil assembly.

Figure 8:
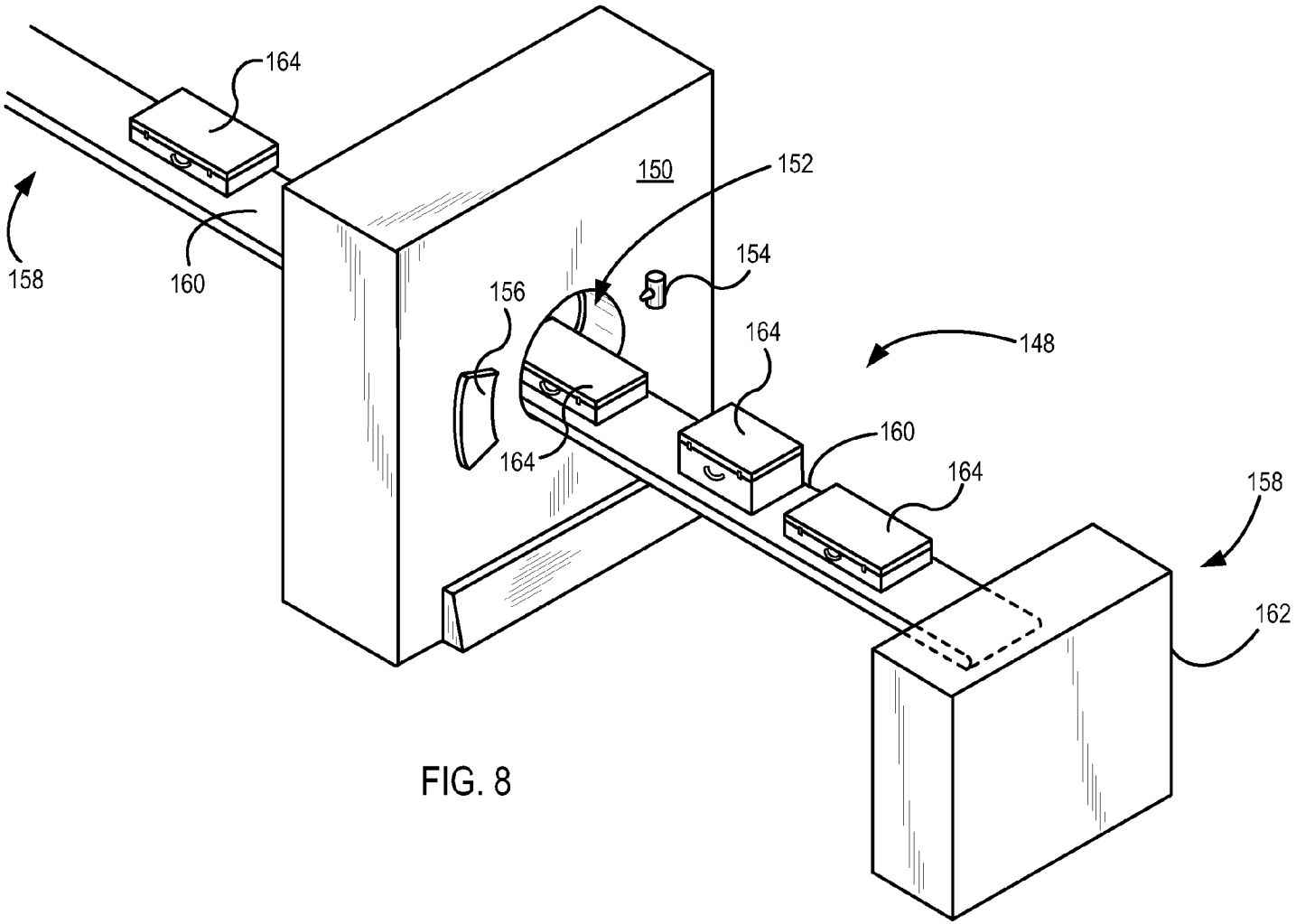
FIG. 8 is a pictorial view of an x-ray system for use with a non-invasive package inspection system according to an embodiment of the invention.

Referring now to FIG. 8, package/baggage inspection system 148 includes a rotatable gantry 150 having an opening 152 therein through which packages or pieces of baggage may pass. The rotatable gantry 150 houses a high frequency electromagnetic energy source 154 as well as a detector assembly 156 having detectors similar to those shown in FIG. 2. A conveyor system 158 is also provided and includes a conveyor belt 160 supported by structure 162 to automatically and continuously pass packages or baggage pieces 164 through opening 152 to be scanned. Objects 164 are fed through opening 152 by conveyor belt 160, imaging data is then acquired, and the conveyor belt 160 removes the packages 164 from opening 152 in a controlled and continuous manner. As a result, postal inspectors, baggage handlers, and other security personnel may non-invasively inspect the contents of packages 164 for explosives, knives, guns, contraband, etc.

Therefore, in accordance with one embodiment, an x-ray tube assembly includes a vacuum enclosure that includes a cathode portion, a target portion, and a throat portion having a plurality of recesses formed therein to break up eddy currents generated in the throat portion. The throat portion has an upstream end coupled to the cathode portion and a downstream end coupled to the target portion. The x-ray tube assembly also includes a target positioned within the target portion of the vacuum enclosure, and a cathode positioned within the cathode portion of the vacuum enclosure. The cathode is configured to emit a stream of electrons through the throat portion toward the target.

In accordance with another embodiment, an x-ray tube assembly includes a housing having a vacuum formed therein. The housing has a cathode portion, a target portion, and a throat portion coupling the cathode portion to the target portion. The throat portion includes a metal wall having a pattern of slits formed therein. The x-ray tube assembly also includes a target positioned in the target portion of the housing, and a cathode positioned in the cathode portion of the housing to direct a stream of electrons toward the target through the throat portion.

In accordance with yet another embodiment, an imaging system includes a rotatable gantry having an opening therein for receiving an object to be scanned, a table positioned within the opening of the rotatable gantry and moveable through the opening, and an x-ray tube coupled to the rotatable gantry. The x-ray tube includes a vacuum chamber that has a target portion housing a target, a cathode portion housing a cathode, and a throat portion comprising a first magnetic field section susceptible to eddy current generation. The first magnetic field section of the throat portion has a first plurality of recesses formed therein. The throat portion forms a passageway between the cathode portion and the target portion for a stream of electrons emitted from the cathode. The imaging system also includes a first electron manipulation coil configured to generate a first magnetic field within the throat portion to manipulate the stream of electrons therein. The first electron manipulation coil is mounted on the x-ray tube and aligned with the first magnetic field section of the throat portion such that the first plurality of recesses break up eddy currents generated by the first magnetic field.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An x-ray tube assembly comprising:
- a vacuum enclosure comprising:
  - a cathode portion;
  - a target portion; and
  - a throat portion having a plurality of recesses formed therein to break up eddy currents generated in the throat portion, the throat portion having an upstream end coupled to the cathode portion and a downstream end coupled to the target portion;
- a target positioned within the target portion of the vacuum enclosure; and
- a cathode positioned within the cathode portion of the vacuum enclosure, the cathode configured to emit a stream of electrons through the throat portion toward the target.

2. The x-ray tube assembly of claim 1 wherein the throat portion has a length defined by a distance between the upstream end and the downstream end; and
- wherein the plurality of recesses are oriented perpendicular to a central axis of the throat portion and are positioned at a plurality of locations along the length of the throat portion.

3. The x-ray tube assembly of claim 1 wherein the throat portion further comprises:
- an upstream section;
- a downstream section; and
- a magnetic field section positioned between the upstream section and the downstream section, and
- wherein the magnetic field section has the plurality of recesses formed therein.

4. The x-ray tube assembly of claim 1 wherein the throat portion comprises a non-ferromagnetic material.

5. The x-ray tube assembly of claim 1 wherein the plurality of recesses are oriented parallel to a central axis of the throat portion.

6. An x-ray tube assembly comprising:
- a housing having a vacuum formed therein, the housing comprising:
  - a cathode portion;
  - a target portion; and
  - a throat portion coupling the cathode portion to the target portion, the throat portion comprising a metal wall having a pattern of slits formed therein; and
- a target positioned in the target portion of the housing; and
- a cathode positioned in the cathode portion of the housing to direct a stream of electrons toward the target through the throat portion.

7. The x-ray tube assembly of claim 6 further comprising a first electromagnetic coil positioned around the throat portion of the housing and aligned with the pattern of slits, the first electromagnetic coil configured to generate a first magnetic field having a maximum magnetic flux density developed in a section of the throat portion having the pattern of slits formed therein.

8. The x-ray tube assembly of claim 7 further comprising a second electromagnetic coil positioned around the throat portion of the housing and aligned with the pattern of slits, wherein the second electromagnetic coil is configured to generate a second magnetic field having a maximum magnetic flux density developed in the section of the throat portion having the pattern of slits formed therein.

9. The x-ray tube assembly of claim 7 wherein the throat portion has an upstream end coupled to the cathode portion and a downstream end coupled to the target portion; and wherein the pattern of slits extends along a length of the throat portion between the upstream end and the downstream end.

10. The x-ray tube assembly of claim 6 wherein the throat portion further comprises:

a first section positioned upstream of the number of slits, the first section having a wall thickness substantially equal to a wall thickness of the cathode portion of the housing; and a second section positioned downstream of the number of slits, the second section having a wall thickness substantially equal to a wall thickness of the target portion of the housing.

11. The x-ray tube assembly of claim 6 wherein the throat portion comprises a non-ferromagnetic metal.

12. The x-ray tube assembly of claim 6 wherein the metal wall of the throat portion has a plurality of slits of varying lengths formed therein.

13. An imaging system comprising:

a rotatable gantry having an opening therein for receiving an object to be scanned;

a table positioned within the opening of the rotatable gantry and moveable through the opening;

an x-ray tube coupled to the rotatable gantry, the x-ray tube comprising:

a vacuum chamber comprising:

a target portion housing a target;

a cathode portion housing a cathode; and a throat portion comprising a first magnetic field section susceptible to eddy current generation, wherein the first magnetic field section has a first plurality of recesses formed therein, and wherein the throat portion forms a passageway between the cathode portion and the target portion for a stream of electrons emitted from the cathode; and a first electron manipulation coil configured to generate a first magnetic field within the throat portion to manipulate the stream of electrons therein, the first electron manipulation coil mounted on the x-ray tube and aligned with the first magnetic field section of the throat portion such that the first plurality of recesses break up eddy currents generated by the first magnetic field.

14. The imaging system of claim 13 further comprising a second electron manipulation coil mounted on the x-ray tube adjacent to the first electron manipulation coil, the second electron manipulation coil configured to generate a second magnetic field within the throat portion to manipulate the stream of electrons therein.

15. The imaging system of claim 14 wherein the second electron manipulation coil is aligned with the first magnetic field section.

16. The imaging system of claim 14 wherein the throat portion further comprises:

a wall section positioned downstream of the first magnetic field section; and a second magnetic field section having a second plurality of recesses formed therein to break up eddy currents generated by the second magnetic field, the second magnetic field section positioned downstream of the wall section.

17. The imaging system of claim 16 wherein the second electron manipulation coil is aligned with the second magnetic field section.

18. The imaging system of claim 13 wherein the throat portion comprises a non-ferromagnetic metal.

19. The imaging system of claim 13 wherein the first electron manipulation coil comprises a plurality of poles;

wherein the first plurality of recesses are formed within a plurality of slitted portions of the first magnetic field section; and wherein the plurality of slitted portions aligned with the plurality of poles.

20. The imaging system of claim 13 wherein the throat portion and the first magnetic field section are substantially equal in length.

* * * * *